US006296579B1

(12) United States Patent
Robinson

(10) Patent No.: US 6,296,579 B1
(45) Date of Patent: Oct. 2, 2001

(54) PUTTING IMPROVEMENT DEVICE AND METHOD

(76) Inventor: Lee D. Robinson, 3445 Cascade Ter., West Linn, OR (US) 97068

( * ) Notice: Subject to any disclaimer, the term of this patent is extended or adjusted under 35 U.S.C. 154(b) by 0 days.

(21) Appl. No.: 09/384,931

(22) Filed: Aug. 26, 1999

(51) Int. Cl.[7] ..... A63B 67/02
(52) U.S. Cl. ..... 473/407; 473/409
(58) Field of Search ..... 473/407, 409, 473/150, 168, 169; 273/DIG. 26; 434/252

(56) References Cited

U.S. PATENT DOCUMENTS

| | | | | |
|---|---|---|---|---|
| 3,685,168 | | 8/1972 | Reitz . | |
| 4,655,451 | * | 4/1987 | Townsley | 473/407 |
| 4,666,157 | * | 5/1987 | Bodine et al. | 473/407 |
| 4,783,071 | | 11/1988 | Tattershall . | |
| 5,013,070 | | 5/1991 | Maude, Sr. . | |
| 5,184,817 | * | 2/1993 | Kanelous | 473/404 |
| 5,772,534 | | 6/1998 | Dudley . | |
| 5,797,809 | | 8/1998 | Hyuga . | |
| 6,027,417 | * | 2/2000 | Zoretic et al. | 473/407 |

* cited by examiner

*Primary Examiner*—Steven Wong
(74) *Attorney, Agent, or Firm*—Kolisch, Hartwell, Dickinson, McCormack & Heuser, PC

(57) ABSTRACT

A method and device for improving putting. The device includes a representation of a green on which a plurality of putting benchmarks are projected. The representation may also include elevation indicia and indicators of the speed and predominant grain direction of the green. The device is used to enable golfers to accurately read the green and determine the speed and direction along which a particular ball should be putted. Methods of using and creating the device are also disclosed.

38 Claims, 7 Drawing Sheets

PUTTING IMPROVEMENT DEVICE AND METHOD

FIELD OF THE INVENTION

The present invention relates generally to golfing, and more particularly to a method and device for improving putting.

BACKGROUND AND SUMMARY OF THE INVENTION

An important element of every golfer's game is putting. With approximately half of most golfer's strokes occurring on or near the green, putting can often make the difference between playing well and playing poorly. As golfers improve their skills, being able to putt well continues to be extremely important. Many tournaments are decided by differences of one or two strokes, with the advantage often being gained or lost on account of whether a difficult putt is made. Therefore, regardless of a golfer's level of skill, being able to accurately read a green to determine the angle and force to use for a particular putt remains an important part of a golfer's game.

However, accurately reading a green is difficult to do, especially when the golfer is not familiar with the particular course being played or when the golfer is not very skilled at playing golf. Such factors as the type of grass being used, the time of day, the overall slope of the green and surrounding course, subtle variations in the scope of the green, etc. all must be accounted for to read a green accurately. The present invention is a device and method for improving putting. More specifically, it provides a mechanism for a golfer to accurately gauge how a particular putt will travel over the green based on determined lines of travel.

Many features of the present invention will become manifest to those versed in the art upon making reference to the detailed description which follows and the accompanying sheets of drawings in which preferred embodiments incorporating the principles of this invention are disclosed as illustrative examples only.

DETAILED DESCRIPTION OF THE INVENTION

Figure 1:
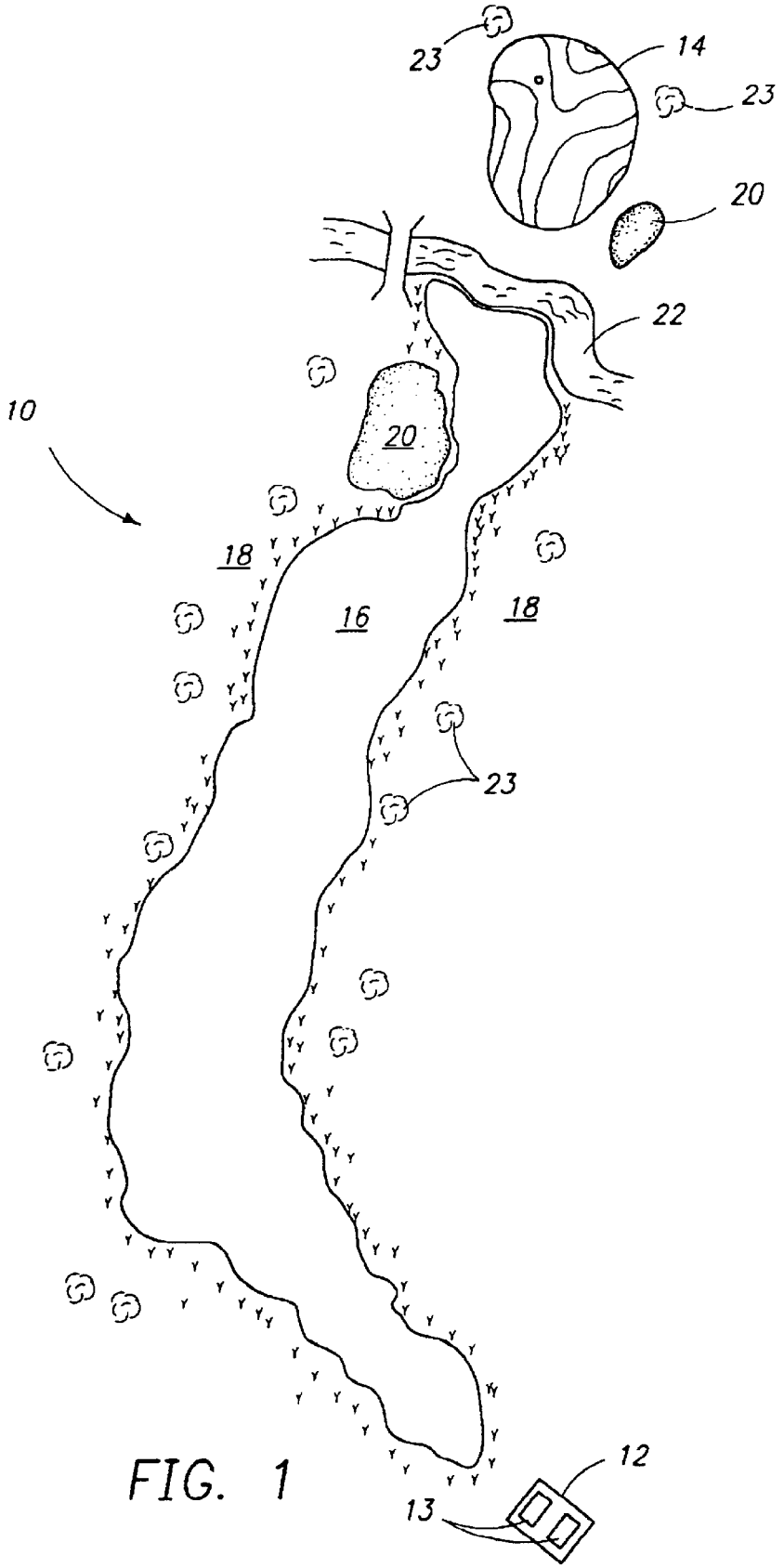
FIG. 1 is a schematic top plan representation of a golf hole.

An example of a typical golf hole is shown in FIG. 1 and generally indicated at 10. Hole 10 includes a tee area 12 having at least one tee box 13 and a green 14 distal the tee area. Between tee area 12 and green 14 lies a fairway 16 bounded on each side by rough 18. Also shown in FIG. 1 are bunkers, or sand traps, 20, a water hazard 22, and trees 23.

Figure 2:
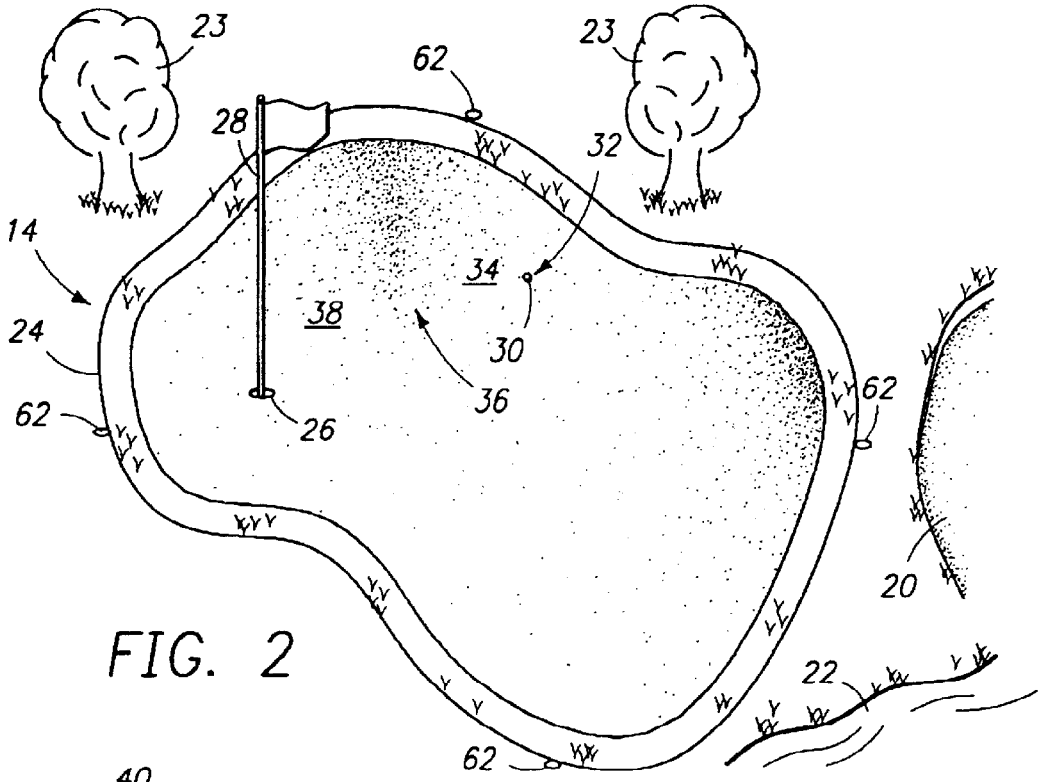
FIG. 2 is an isometric view of the green shown in FIG. 1.

Green 14 is shown in more detail in FIG. 2 and is surrounded by an apron 24, which is a region of grass that is typically longer than the grass forming the green and shorter than the grass forming the fairway. Green 14 also includes a hole, or cup, 26 into which a pin 28 is removably received. Although green 14 may be horizontal, greens typically have a 1–3% slope incorporated therein for drainage and have complex curved surfaces with curved rises and depressions that make it difficult to accurately predict how a putted golf ball will travel over the green. Therefore, in addition to the curvature of particular regions of the green, green 14 may also extend at an overall angle to a horizontal plane. Similarly, the surrounding structures may be inclined to confuse golfers into thinking the green is more or less inclined than it really is.

For example, a golf ball is indicated at 30 in FIG. 2 on a region 32 of green 14. As shown, the distance from ball 30 to hole 26 along the surface of the green is not level. Instead, the ball must travel up a slope 34, then along a region 36 inclined at a different angle than region 32, and then down another slope 38 to cup 26. Because of the slopes and curvature of the regions of green 14 over which ball 30 must travel, it is difficult to accurately predict the path along which the ball will travel when putted.

Figure 3:
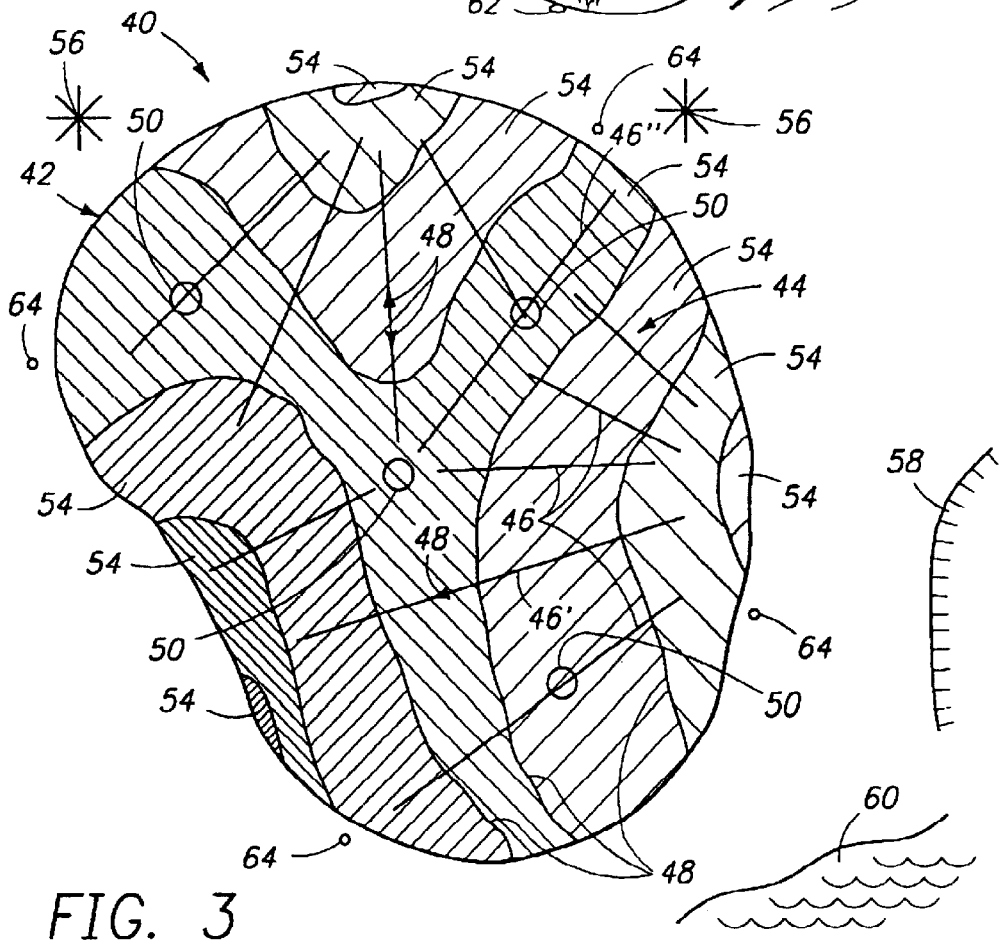
FIG. 3 is a top plan view showing an embodiment of a putting improvement device constructed according to the present invention and including a representation of the green of FIG. 2.

A golfing aid constructed according to the present invention is shown in FIG. 3 and generally indicated at 40. Aid 40, which also may be referred to as a putting improvement device, improves a golfer's putting by enabling the golfer to more accurately predict the path of a putted ball. Responsive to predetermined paths of travel indicated on device 40, which are referred to herein as putting indicia, the golfer is able to determine the path along which a putted ball will travel on the green.

As shown in FIG. 3, device 40 includes a graphic representation 42 of green 14 and includes at least one putting indicia 44, which in FIG. 3 is in the form of at least one putt line 46. In FIG. 3, plural putt lines 46 are shown and, in the illustrated embodiment, each indicates a line of straight putt. By this it is meant that a ball putted along a corresponding line 46 on green 14 will follow the line without diverging, or breaking, to either side. It should be understood that representation 42 and putting indicia 44 are illustrated herein for illustrative purposes only, with actual empirical measurements required to determine the exact placement of the putting indicia on representation 42. Putting indicia 44 may also be referred to as putting benchmarks because they represent determined, or fixed, paths along which golf balls will travel on green 14. Therefore, golfers who have never previously putted on green 14 or who are not skilled at reading greens can rely upon these defined benchmarks to determine the path along which a particular ball should be putted on green 14.

Straight putt lines 46 may indicate straight putts in one direction, or in both directions, and therefore may include directionality arrows, such as shown at 48 in FIG. 3. Factors that may affect whether any of the putting indicia disclosed herein are one- or two-directional, include whether green 14 includes a predominant grain direction, and the slope of green 14 at the end points of the indicia. The slope, or break, in a particular region of the green will affect slow moving balls more than faster moving balls. Therefore, some straight putt lines 46 may only represent straight paths for balls traveling in one direction along the line, with balls traveling the other direction tending to diverge from the particular putt line 46. Similarly, balls traveling in one direction with respect to the grain of the green may travel along a path that corresponds to one of the putt lines, but travel along a different line if putted in the reverse direction.

The actual distance represented by particular putt lines 46 may vary. Generally, lines 46 should represent at least two feet, and often times will represent distances between approximately five feet and approximately twenty feet. Lengths outside of this range are also within the scope of the invention. For example, in regions of extreme elevation changes or complex curvature, it may be desirable to have shorter putt lines to detail lines of straight putts extending through that region, with longer putt lines used in regions with less complex curves or changes in elevation.

It is preferable that lines 46 are as long as possible so that the most comprehensive information is provided to a golfer using device 40. The length of line 46 is at its maximum when a ball putted along the line reaches the end of the depicted line and then deviates from the straight line along which it had been following.

Although multiple straight putt lines 46 are shown in FIG. 3, it should be understood that larger or smaller numbers of such lines may be used. In general, the number should be selected after considering such factors as the size of the green, whether difficult regions of the green have been accounted for, whether all desired pin positions have been accounted for, and the degree of specificity to which device 40 is to be created. For example, for most players it may be acceptable to have several putt lines for each regularly recurring pin position. However, for players desiring additional guidance, additional straight putt lines may be used, such as to provide additional guidance for these recurring positions or to provide guidance on other locations of the green.

Because the pin positions used on a particular green tend to be frequently repeated and to be relatively low in number, putt lines 46 are preferably selected to extend proximate, or even through, a recurring pin position. As an illustrative example, four recurring pin locations are generally indicated at 50 in FIG. 3, with lines 46 extending through or near one or more of these positions. It should be understood that the exact placement of hole 26 may vary, but will tend to be located within or very close to the recurring pin positions 50 shown in FIG. 3. Therefore, although there are countless lines of straight putts that may be identified for a particular green, knowing the most common pin positions allows putting indicia to be selected that generally correspond to these positions. Device 40 may include putting indicia 44 that extend through regions of the green spaced-apart from one of the recurring pin positions 50, however, it is preferred that at least a few of the indicia correspond to these recurring positions 50.

In FIG. 3, it can be seen that device 40 further includes elevation indicia in the form of contour, or elevation, lines 52 that define regions 54 of different elevation on green 14. As shown, shading is used to represent changes in elevation, with darker shades representing lower elevations and lighter shades representing higher elevations. Therefore, if a ball needs to travel from a light region to a darker region, it will travel down a slope. The shading used in FIG. 3 is presented as an illustrative example of one suitable way to differentiate the elevation of regions 54, however, any other suitable method may be used.

It is within the scope of the present invention that device 40 may include more or less contour lines 52 than shown in FIG. 3. Typically, the number of contour lines and the elevation difference between each contour line are selected to most easily show the indentations and slopes of a particular green. Factors that may affect the number of contour lines used on the representation of a particular green include user preferences, the overall change in elevation on the green, the severity of the contours, and irregularities in the elevation on the green. For example, a relatively level or gently sloped green will typically require less contour lines than a green with multiple rises and depressions or a green with a greater overall range of elevations. However, the more contour lines used on a particular representation, the more information provided to a golfer to accurately read a green.

In FIG. 3, it can also be seen that putt lines 46 often extend through more than one region 54. When this occurs, the portions of putt lines 46 extending through different regions may be referred to as fall-line indicators, in that they demonstrate how a ball will travel as it rolls up or down an incline on green 14. Most of the putt lines shown in FIG. 3 extend through a plurality of elevations, with the exact number of general regions of elevation varying depending on the particular region of the green through which a particular putt line 46 extends. For example, in FIG. 3 it can be seen that one putt line 46' extends through four contour regions, while another 46" extends through only a single region. Of course, as the number of contour lines 52 is increased, it is more likely that the putt lines will extend through multiple regions 54. Also, because a particular golfer's putt only needs to travel within a single region does not mean that the putt would automatically travel along a straight line within that region. Even within a single region 54, balls will tend to travel along irregular, non-straight lines because of such factors as the degree of elevation change between contour lines 52, irregularities in elevation within a particular region 54, the grain of the green in the region and the direction the ball must be putted with respect to the grain. Therefore, straight-putt lines 46 within a single region 54 are also useful to help a golfer accurately read a green and putt more accurately.

Device 40 may further include indicia representing landmarks surrounding green 14. For example, in FIG. 3, bunker 20, water hazard 22 and trees 23 are represented respectively at 56, 58 and 60. Also shown in FIG. 2 are sprinkler heads 62, which are depicted in FIG. 3 at 64. These landmarks enable a golfer to more easily orient representation 42 with respect to green 14 so that the position of pin 28 and the golfer's ball on green 14 may be translated to corresponding positions on representation 42. Once these positions are known, the elevation and/or putting indicia may be used to read the green and thereby determine the proper path and speed along which the ball should be putted.

Other graphical indicia may be used to indicate the slope of green 14. It is also within the scope of the present invention that device 40 may include a representation of green 14 that does not include any contour or elevation lines or markings, and instead includes only the putting indicia 44 described herein. However, both the putting indicia described herein and any suitable form of elevation indicia are preferred because the elevation indicia, such as contour bands or shading, better enable a golfer to interpolate the path of putts that do not travel directly along one of the putting indicia described herein. Both indicia are also useful to determine whether the putt is traveling uphill or downhill, which is important when determining the speed of the putt. This is particularly helpful when the region of the green over which a ball will be putted extends only slightly uphill or downhill, in which case it may be difficult for the golfer to otherwise know that the green extends at an angle to the horizontal.

Figure 4:
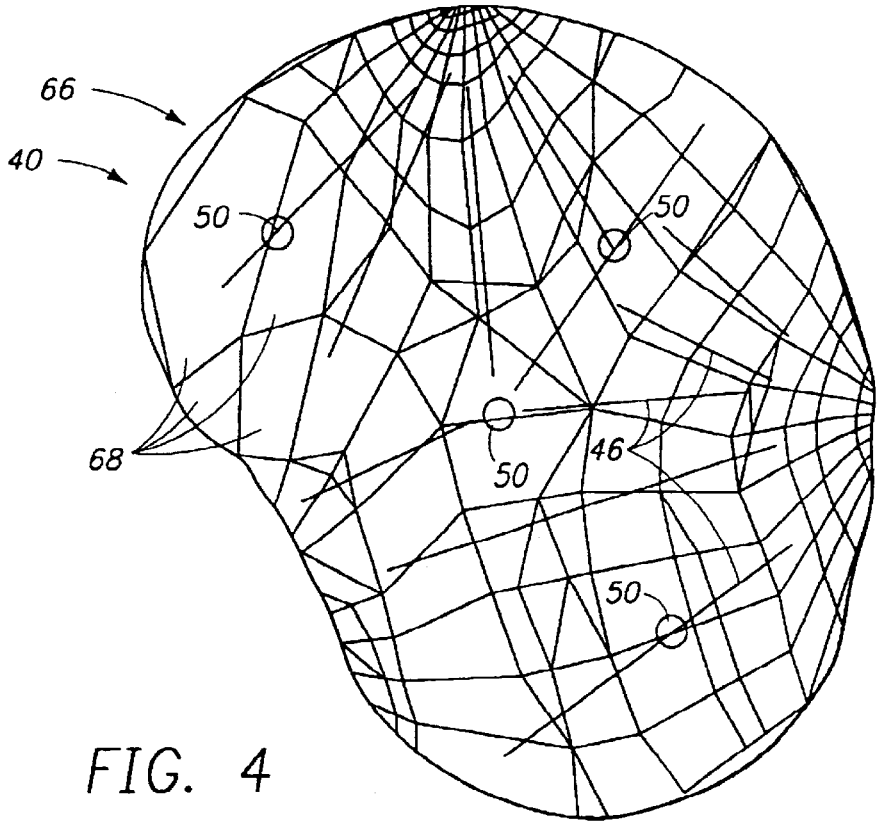
FIG. 4 is a schematic top plan view showing the device of FIG. 4 including another representation of the green of FIG. 2.

In FIG. 4, device 40 is shown with another suitable representation of the elevation of green 14, which is generally indicated at 66. Representation 66 includes a graphic representation of the green 14 reduced to planar geometric surfaces 68. This modeling technique is known in the art of computer simulation, although its use to model golf greens is not known. FIG. 4 is presented to demonstrate that the particular method of representing the curvature and elevation differences on green 14 should not be limited only to contour lines 52. It should be understood that when the representation of FIG. 4 is used with the invented putting aid, it may include any of the putting indicia 44 described and illustrated herein.

Still another suitable representation of the elevation of green 14 is with a plurality of arrows that indicate the general slope of the green in the region upon which the arrow is shown. An example of this technique is demonstrated in U.S. Pat. No. 5,797,809 to Hyuga, the complete disclosure of which is hereby incorporated by reference. Any of the putting indicia 44 described herein may be used with this representation of green 14 as well.

Because some greens will contain areas of complex curvature through which no straight putt lines 46 of any suitable length may be drawn, those regions may not have any putting indicia depicted in the representation of the green. Alternatively, it is within the scope of the present invention that putting indicia 44 may include embodiments other than straight putt lines 46, as described in more detail below.

Figure 5:
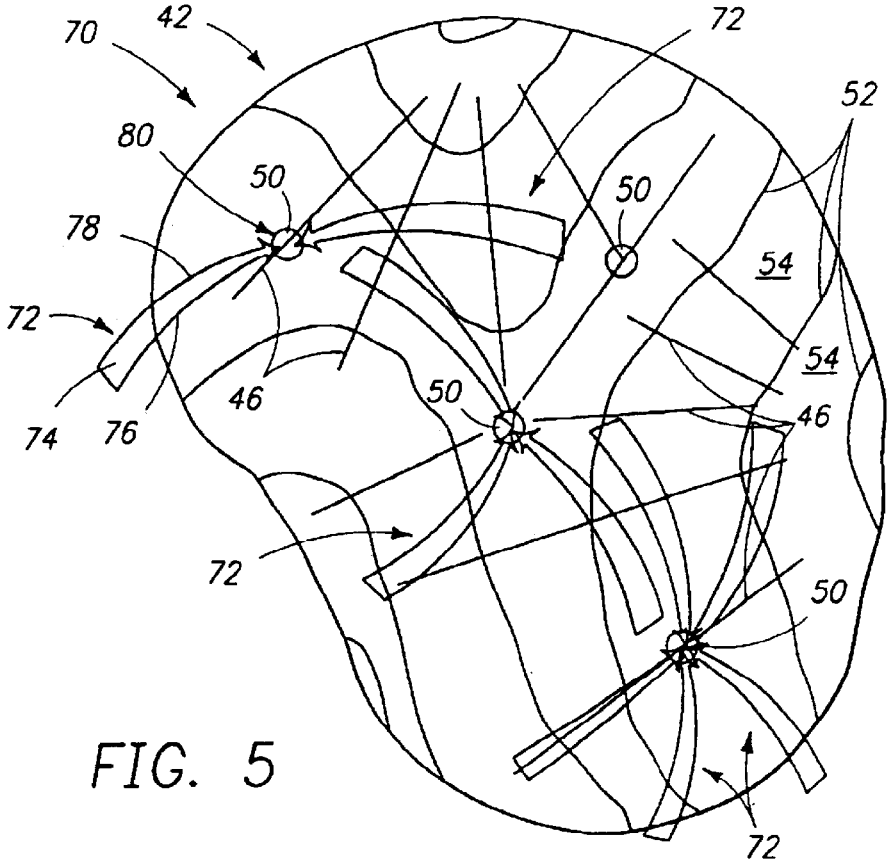
FIG. 5 is a top plan view showing another embodiment of the device of FIG. 3.

Another embodiment of putting improvement device 40 is shown in FIG. 5 and generally indicated at 70. In FIG. 5, representation 42 of green 14 includes another embodiment of putting indicia 44, in the form of convergence bands 72 that define regions 74 through which putts will travel to a common terminus. As shown, each region 74 is bounded by putt-lines, 76 and 78, which may be either linear or curved. The shading used in FIG. 3 to depict changes in elevation between the particular regions 54 of representation 42 have not been repeated in FIG. 5 for purposes of clarity. It should be understood that in an actual embodiment of the invented device, the colors, shading and identifying symbols used may vary, and those depicted herein are presented merely as non-limiting examples.

Unlike the lines of straight putt 46 shown in FIG. 3, bands 72 define regions 74 (as opposed to lines) of the green through which putts will tend to converge to a common location 80. This location may be one of the recurring pin positions 50, but it is within the scope of the present invention that it could also be other locations on the green. For example, it may be desirable to have a convergence band 72 showing how putts traveling down a slope will converge to a common location after the slope levels out. From this location, the green may be level and relatively easy to read, or the representation may include another putting indicia, such as a straight putt line 46 showing how the now-converged paths of the putted balls will travel from that location.

Figure 6:
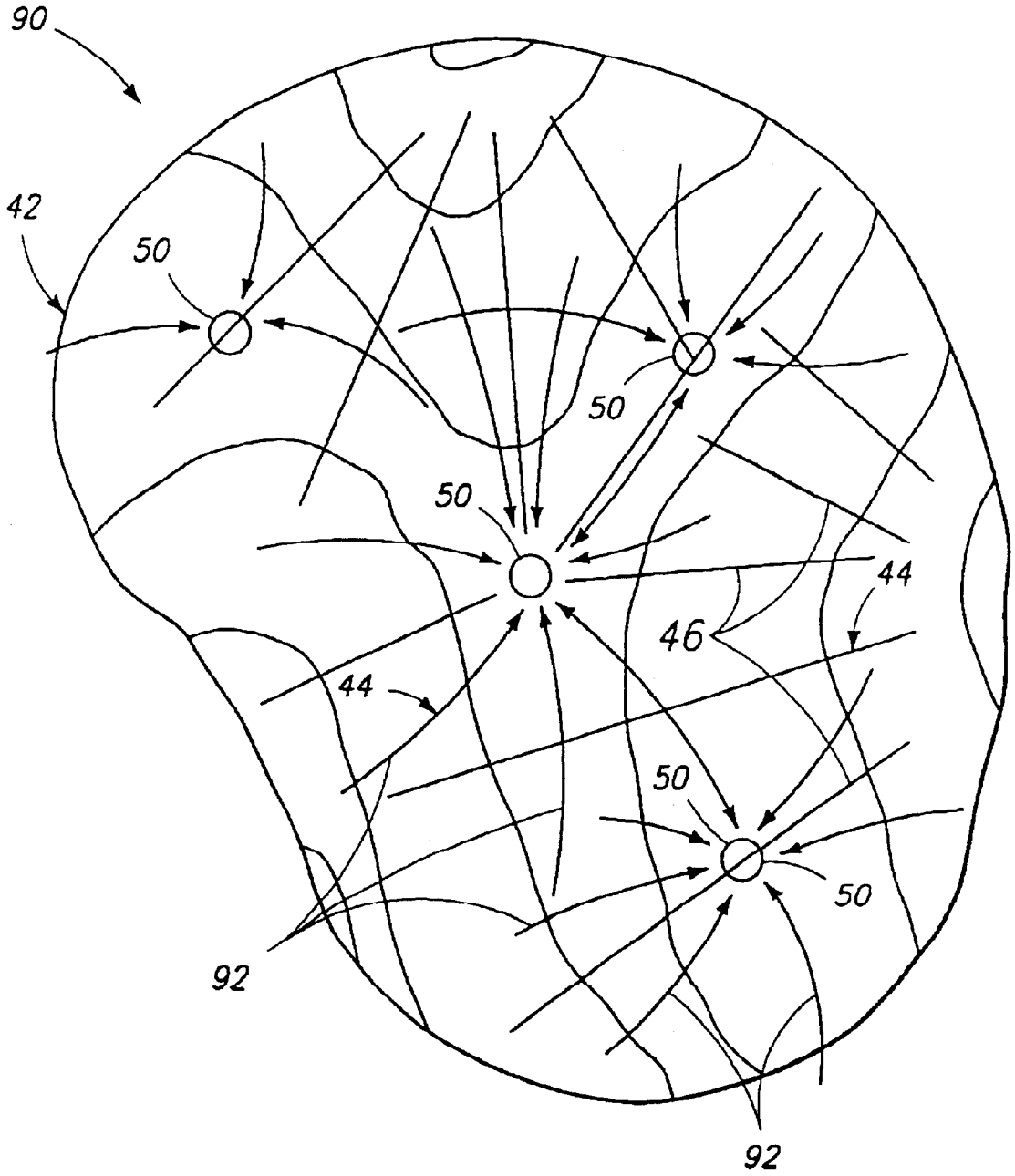
FIG. 6 is a top plan view showing another embodiment of the device of FIG. 3.

It should be understood that putting indicia 44 may have other configurations than the straight putt lines 46 shown in FIG. 3 or the convergence bands 72 shown in FIG. 5. For example, putting indicia 44 may also include putt lines that are not straight and instead curve or bend to show the breaking path of balls putted along these lines. An example of such an embodiment of device 40 is shown in FIG. 6 and generally indicated at 90. In FIG. 6, the pin locations 50 of FIG. 3 are shown, only further including a plurality of putting indicia 44 in the form of curved putt lines 92 radiating outwardly therefrom. Also shown in FIG. 6 is a plurality of straight putt lines 46. Similar to the other embodiments of putting indicia 44 described herein, curved putt lines 92 may also extend along the representation of the green in locations other than those starting or ending at recurring pin positions 50. For example, it may be desirable to use curved lines 92, or a combination of multiple ones of the putting indicia described herein to indicate how putts will travel up or down slopes and inclines, even if those slopes and inclines are not necessarily adjacent a recurring pin position. Curved putting indicia 44 may also be either one- or two-directional, and may include corresponding direction indicators, as discussed above.

It is within the scope of the present invention that one or both of the contour and putting indicia may also extend beyond the perimeter of the represented green, such as to include apron 24 of green 14 or even to include the terrain surrounding the apron. Although only the particular green 14 is discussed herein, it should be understood that green 14 is presented as an example of device 40 adapted for use on that particular green. The invented putting improvement device may be adapted for use on any green, as discussed in more detail below, and as shown has been particularly adapted for use with green 14.

Figure 7:
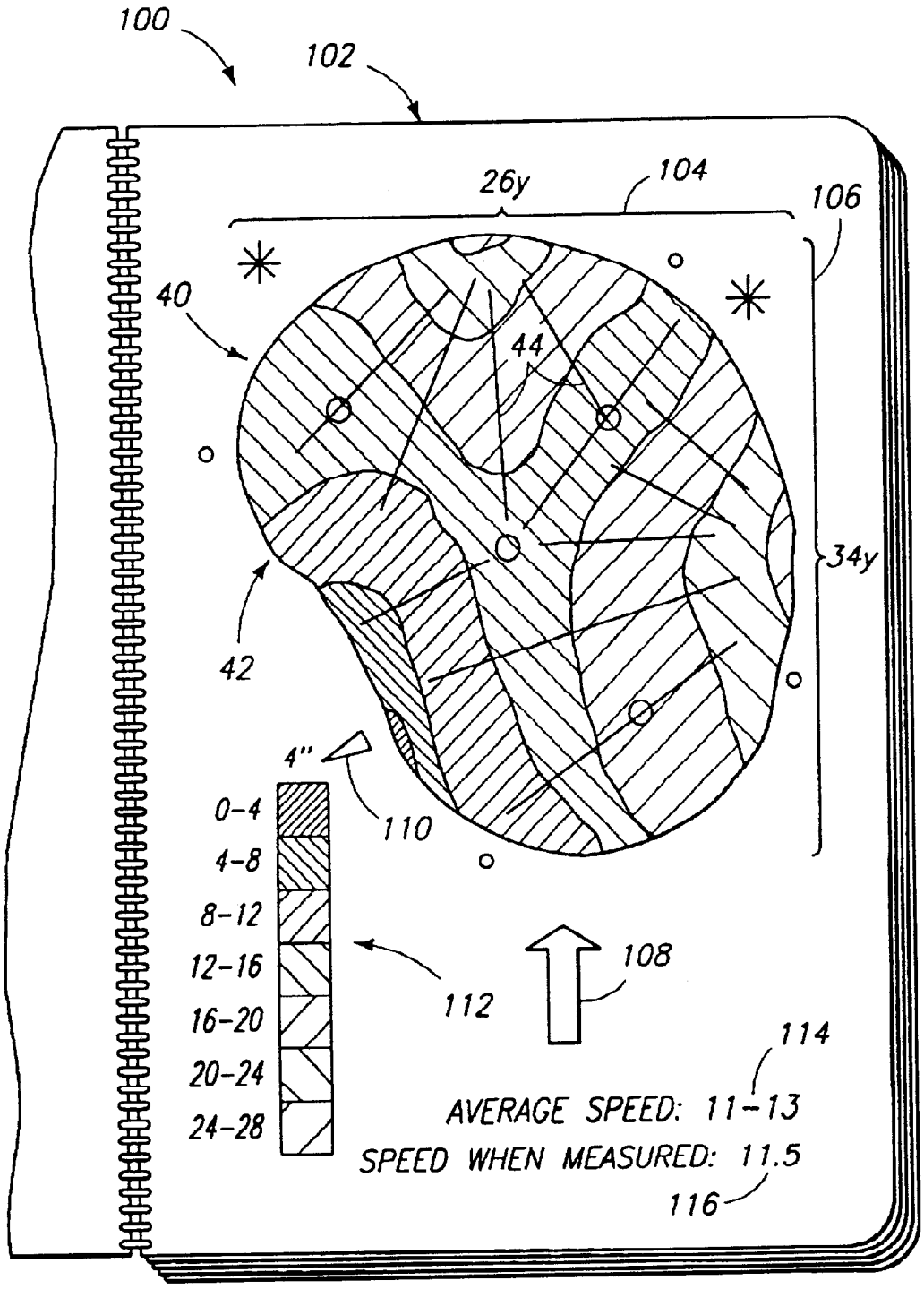
FIG. 7 is a top plan view showing another embodiment of a putting improvement device constructed according to the present invention.

Any of the versions of the putting improvement device disclosed herein may be embodied on a page of a booklet, such as indicated generally at 100 in FIG. 7. Booklet 100 preferably includes one or more representation for each green on the course. In the embodiment shown in FIG. 7, booklet 100 includes multiple pages 102 secured together. It is within the scope of the present invention that booklet 100 is meant to include both single- and multi-paged books, posters, cards, placards, signs, leaflets, and the like. For example, booklet 100 may include a chart depicting all of the greens on a particular course, a hand-held pamphlet with individual pages or regions for each green on a course, a sign located near a particular green and adapted to depict only that green, etc.

As shown in FIG. 7, page 102 includes a representation of a green, including at least one of the embodiments of putting indicia 44 described herein. As shown, page 102 includes representation 42, straight putt lines 46 and contour lines 52, which were previously discussed with respect to FIG. 3.

Other information that may, but not necessarily, be included on page 102 includes horizontal and vertical scales 104 and 106 showing the dimensions of the actual green represented. Another suitable method of indicating the scale of the representation is to identify the ratio between the size of the actual green and the size of the represented green, such as by indicating that each inch on the representation corresponds to ten feet on the actual green. Page 102 may also include an indicator, such as arrow 108, showing the direction from which the green is approached from the fairway. An indicator 110 of the prominent grain direction of the green is also shown in FIG. 7. Indicator 110 is useful when the green includes grass with a prominent grain direction, such as Bermuda grass. With such a green, the path along which a ball will travel will be affected, depending if the ball is traveling with, against, or transverse to this prominent grain direction. Therefore, indicating the prominent grain direction enables a golfer to know this actual direction without having to estimate it on the course and to use this information to more accurately determine the force and path of a putt.

Page 102 also includes an elevation scale 112 showing the elevation range defined by contour lines 52. As shown, scale 112 indicates that each region 54 between adjacent contour lines 52 spans four inches of elevation change. As discussed, scale 112 may vary depending upon the level of detail desired. For example, the differential between adjacent contour lines may be intervals of less than four inches, such as one-inch intervals, or it may be in intervals greater than four inches.

In FIG. 7, the average speed 114 of the green and the speed 116 of the green when the putting indicia were determined are shown. These values are determined by any suitable method, such as by using a Stimpmeter or other suitable device. A Stimpmeter measures the distance a ball travels over level ground given a defined impulse. A Stimpmeter is a metal ramp that is about three feet long with a chute down the middle and a notch about six inches from one end. To use a Stimpmeter, a golf ball is placed within the notch and that end of the Stimpmeter is raised from the surface of the green until gravity forces the ball out of the notch, down the chute and onto a level section of the green. The distance the ball travels on the green is the speed value. Typically, greens are measured twice, once in each direction, with the average length of the roll, in feet, being the Stimpmeter reading for the green.

Average speed value 114 provides a golfer with a measurement of the speed of a particular green or course relative to other greens or courses. This is particularly useful when the golfer is playing a course that the golfer has not played before. For example, if the golfer regularly plays a course having greens with an average speed of 8–10, then the golfer will know that balls will tend to travel further on green 14 because the green has a higher average speed value. Therefore, the golfer will know to putt with less force than the golfer would otherwise use on the familiar course.

Another way of describing the usefulness of average speed value 114 is that many golfers have benchmark levels of force that they use to gauge the relative speed of a green. For example, suppose a golfer's standard putt normally travels twenty feet on a green with an average speed of 9. On green 14, however, a twenty foot putt will require less than the force needed for this standard putt because green 14 has a higher average speed value.

Knowing the speed of the green when putting indicia 44 were measured is helpful because it enables a golfer to adjust how a green is read depending on whether the magnitude of measured speed value 116 relative to average speed value 114.

Instead of depicting values 114 and 116 as shown in FIG. 7, these values may also be included elsewhere in booklet 100, such as in a table in which the average and measured speed values for each green are presented. Any of the other information about the greens (hardness, overseeding, growth rates, prevailing wind, etc.) that may vary from green to green may also be presented in this or another table. When these values are relatively constant for all greens represented in booklet 100, then booklet 100 may include a single identification of these values, such as in an information section, as discussed subsequently. It is also within the scope of the invention that booklet 100 does not include values 114 and 116.

Booklet 100 may include more than one representation for each green. For example, multiple representations may be used to identify a larger number of possible pin positions. This may be useful in tournaments or other competitive matches where the pin may be placed in a less-standard position to make the hole more challenging. In fact, one representation may be shown for each possible, or likely, pin position. By including only one pin position per representation, additional putting indicia 44 may be shown to provide detailed guides to how balls from relatively any location on or proximate the green will travel when putted toward the pin position. Another reason to use multiple representations for each green is to provide more detailed coverage, or putting indicia, regardless of the number, if any, of pin positions represented.

The putting indicia shown in any representation may include various combinations of straight putt lines 46, convergence bands 72, and curved putt lines 92. To make the device easier to read when multiple pin positions are shown on a single representation, different colors, markings, thicknesses, etc. may be used to indicate indicia for a particular pin position.

Booklet 100 may also include an instruction section that explains to a golfer how to use the golfing, or putting-improvement device of the present invention. The instruction section explains the various symbols and indicia used in the putting improvement device, as well as how to use the elevation and/or putting indicia to accurately read a green and thereby putt more accurately.

Figure 8:
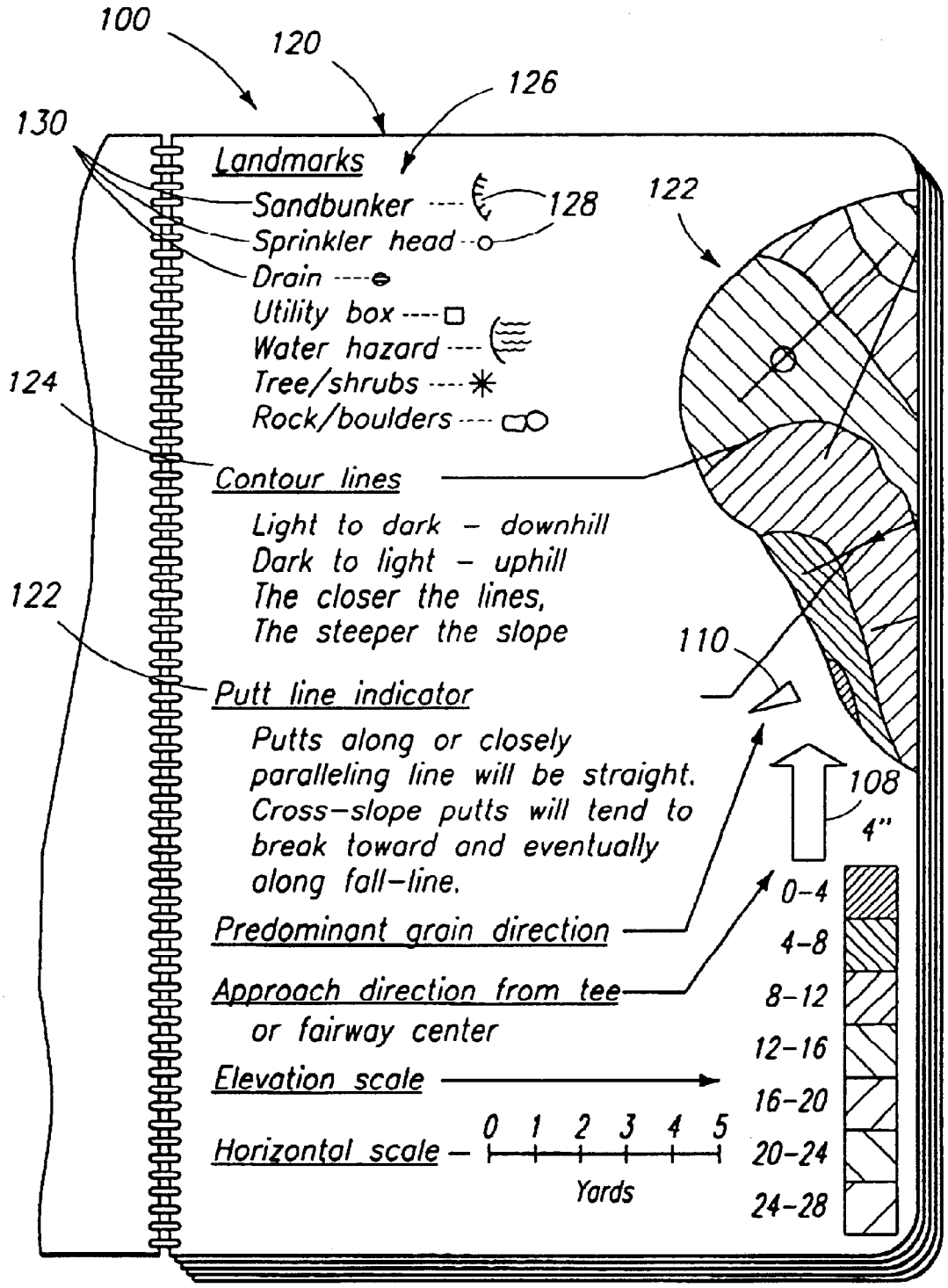
FIG. 8 is a top plan view showing another page of the booklet of FIG. 7.

An example of such an instruction section is shown in FIG. 8 as an additional page 120 of booklet 100. Instruction section 120 teaches a golfer how to use the invented putting improvement device. Section 120 includes an example of a representation of a green, which is generally indicated at 122 and includes at least one embodiment of putting indicia 44. In FIG. 8, representation 122 corresponds to the representation shown in FIG. 3 and includes straight putt lines 46 and elevation lines 52. In addition to showing an example of how greens are represented in booklet 100, instruction section 120 further includes an explanation 124 of how to use putting indicia 44 to read greens. Section 120 may also include an explanation 124 of how to interpret the elevation indicia, such as contour lines 52, as well as an explanation of how to combine the information provided by the putting and elevation indicia. Other elements that may be included in section 120 are visual representations of how putted balls will travel, such as when putted along, adjacent and at an angle to the putting indicia.

In FIG. 8, instruction section 120 further includes a legend 126 describing the various depictions 128 of landmarks 130 that are used in the booklet, such as the trees 60 and sprinkler heads 64 depicted in FIG. 3. Also explained in section 120 are direction and grain indicators 108 and 110, and elevation scale 112.

Figure 9:
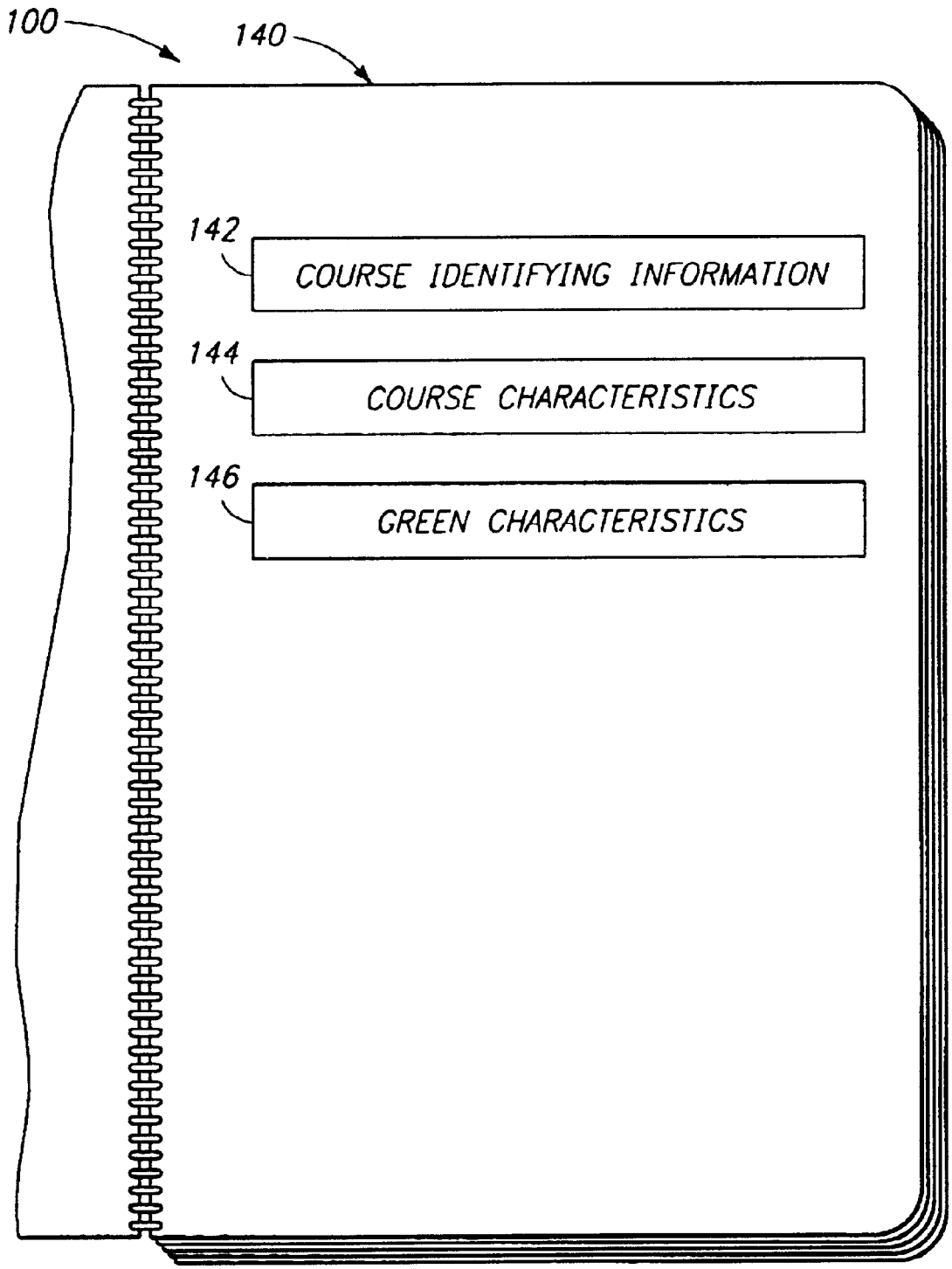
FIG. 9 is a top plan view showing another page of the booklet of FIG. 7.

Instruction section 120 may also include information about the course being played, and especially information about the greens on the course. An example of information that may be included in this section is shown as an additional page 140 of booklet 100 in FIG. 9. Page 140 includes course-identifying information 142 and general course characteristics 144. Examples of course-identifying information 142 include the name, designer and creation date of the course. Examples of general course characteristics 144 include the length and style of the course, handicap rating, type of grass used in the fairway, and amenities.

It is preferable that page 140 also includes particular information 146 about the greens used on the course. An example of a green characteristic that may be presented in this section, or page, is the type of grass used on the greens. This information helps golfers determine how to adjust their putts depending upon the type of grass and the particular characteristics thereof. For example, rye and bent grass tend not to have any directionality, while Bermuda grass tends to have a grain that extends toward the setting sun. Other suitable green characteristics that may be presented in section 140 include smoothness, firmness, overseeding and growth rates. The average and/or measured speeds of the greens may also be included in this section, or elsewhere within booklet 100.

To use any of the embodiments of the putting improvement device discussed herein, a golfer first identifies the positions on the device that correspond to the positions of the golfer's ball and pin 28 on green 14. Typically, this involves first orienting the device with respect to the actual green, such as by aligning the landmarks adjacent the actual green with their corresponding depictions on the device. Once these reference positions are located on the device, such as on representation 42 of device 40, the golfer next determines whether any of the putting indicia 44 connect the golfer's ball to the pin. If so, the device demonstrates the exact path along which the golfer should putt the ball. If not, the golfer uses the putting indicia as determined, tested benchmarks to select the path along which the ball should be putted.

For example, downhill putts transverse to a straight putt line 46 will tend to break downhill and eventually along the straight putt line. Putts extending near and generally parallel to a straight putt line 46 will tend to also go straight, unless the elevation indicia indicates a change in elevation along the path through which the ball will be putted. Putts extending transverse to straight putt lines 46 will break from higher elevation regions toward lower elevation regions, or from light to dark if the coloring or shading scheme described herein is used. Putts lying anywhere within convergence bands 72 will follow the curvature of the extremes 76 and 78 of the band to the terminal position 80. Other information used by the golfer to determine the path and speed of the putt are speed values 114 and 116, such as shown in FIG. 7, and the elevation indicia, such as contour lines 52 shown in FIG. 3.

As discussed above, the invented putting improvement device enables a golfer to more accurately determine the path along which a ball should be putted, even if the golfer's ball and/or pin position does not lie along one of the putting indicia depicted on the representation of the green being played. In those situations, the putting indicia provide benchmarks from which the golfer may interpolate the path along which a ball should be putted. Also speed, elevation and grain information allow the golfer to more accurately gauge the force which should be used for a particular putt. For example, putts against the grain will tend to require more force, i.e. be slowed, than putts traveling in the direction of the grain. Putts extending through several very close contour lines 52 will be traveling down a steeper slope than putts in which the contour lines are spaced further apart.

An important aspect of putting is mental and depends upon a golfer's confidence that the green has been accurately read. When the golfer is confident that the selected path along which the ball will be putted is accurate, indecision is reduced or eliminated during the execution of the putting stroke. This results in a smoother, more accurate stroke that is not misdirected through pauses, jerks or improper force, which stem from this indecision. The putting improvement device of the present invention reduces indecision by providing established benchmarks that a golfer can use not only to select the path along which a ball will be putted, but also to add confidence to the putt by continuing the user's selected speed and break.

The putting improvement device also helps beginning or less skilled golfers learn how to read greens. Some contours may be too subtle for some golfers to detect, but will affect the course of a putted ball nonetheless.

The elevation and putting indicia depicted in any of the embodiments of the putting improvement device described herein are created using survey equipment and empirical testing. More specifically, survey equipment is used to obtain data corresponding to the shape of the green and the topographical profile of the green. Other data that may be obtained include the locations of recurring pin positions on the green and the locations of landmarks relative to the green.

The data may be obtained using any suitable surveying equipment. One suitable example is the Leica TCA 1105 Total Station manufactured by Leica Geosystems. This equipment has proven particularly effective because it only requires one operator. Another example is the Leica TPS1100 Professional Series Total Station. Of course, other automated, semi-automated and manual techniques may be used, but techniques producing computerized data are preferred because the data is less likely to contain errors and because the data may be used by software to create any of the embodiments of the device described herein.

A drafting program receives the survey data and uses this data to create the representation of the measured green shown in the putting improvement device. Typically, the representation, such as representation 42, is created responsive to user inputs, such as to determine this type of graphical representation to use, and the level of detail to be used in the representation. For example, when contour lines are used, such as shown in FIG. 3, the user may select the number of contour lines or the elevation span between adjacent lines. Understandably, the accuracy of the representation will depend upon the number of data points obtained and the number of intervals into which this data is divided. Typically several hundred data points are required to accurately represent each green, with increased numbers of data points required for larger greens, greens with severe changes or fluctuations in elevation, or representations in which very small changes in elevation are to be represented. Because the locations of landmarks are determined using the survey equipment, they will be accurately located with respect to the green, and therefore should not be inaccurately positioned through human error.

Once the representation and elevation indicia are created, the user may also use the software to add optional information to the created device, such as demarcations to represent different elevations, legends, scales, indicators, speed, grain, etc. It should be understood that the method of obtaining data and creating the graphical representation of the green and the elevation indicia depicted thereupon is presented as one suitable method, and that any other suitable method may be used as well so long as one of the invented devices described herein are created. For example, the method described above involves computerized survey and drifting equipment, however, either or both of these steps could be performed manually. However, the above method is preferred because it reduces the time and effort required to create the device, while also minimizing the possibility of human error.

The putting indicia described herein are determined manually by measuring the path of balls traveling on the actual green being measured. Preferably, balls being used are propelled along the green using a reproducible amount of force so that measurements may be verified and repeated as necessary. One suitable way to do this is to use a Stimpmeter or similar device in which a golf ball is rolled down a ramp from a determined height. Because the height at which the ball is released is known, it is possible to "putt" many balls using the same force. If the guide is not moved, then golf balls released from the same height should follow the game path along the green.

As an example, when a straight putt line is desired, a golf ball is propelled in a selected direction and with a selected force along the green. If the path of the ball along the green fails to meet the selected criteria, which in this example is a straight line, then a new starting position or direction is selected. If the golf ball initially travels along a path meeting the selected criteria, then the golf ball is propelled along the original path with less force until the position along the path at which the ball will deviate from the selected criteria is determined. Once a path meeting the selected criteria is identified, the length of this path, or putt line, is preferably maximized by propelling a golf ball with additional force to determine the maximum distance the ball will travel along the path until the ball deviates from the path.

When a two-directional putt line is desired, the above process is repeated from the opposite end of the originally determined path to determine whether the ball will also travel along the path in the opposite direction. If so, then a two-directional putt line is known. If not, then the above process is repeated to determine if a shorter two-directional putt line is possible along the originally determined path, or whether no two-directional putt line is possible along that path.

When one-directional curved putt lines are desired, then the selected criteria may be that the path determined by the ball is of a sufficient length to the user, or that the path extends through a selected location on the green. When two-directional curved putt lines are desired, then the prevailing criteria is that a golf ball will travel along the same curved path regardless of the direction in which the ball is putted along the path. Other criteria may also be used, such as a selected length or a position of the green through which the path extends. When a convergence band is desired, the prevailing criteria is that a golf ball putted from anywhere within the selected region will travel to a terminal location on the green. The length of the boundaries of the region and the paths defined thereby are selected as described above with respect to one-directional straight or curved putt lines.

When lines of straight putt are being determined, it is desirable to indicate whether the lines represent one- or two-directional lines of straight putt. For example, on greens that do not have any directionality in their grain, lines of straight putts should be two-directional, in that balls putted in either direction along the line should still travel in straight lines.

When a green having a predominant grain is being modeled, at least some of the lines of straight putt will likely be only one-directional, in that putts traveling in the other direction along the line will not follow a straight line because of the influence of the grain of the grass on the ball's path. Also putts extending across an incline may only be one-directional because the slope, or break, of a particular region of a green will tend to affect the path of a golf ball differently depending on the speed at which the ball is traveling. Therefore, a putt line that starts across an incline and terminates along a relatively level surface will unlikely be two-directional, in that putting in the reverse direction will most likely cause the ball to diverge from the putt line as it travels along the incline as the ball slows to a stop. Also greens with a predominant grain direction are more likely to have one-directional putting indicia because grain will tend to affect putts differently depending upon the direction the ball is traveling.

Once the selected putting indicia are measured and verified by empirical testing, the end points of the indicia are preferably recorded with the above-described survey equipment so that these end points are accurately located on the representation of the green. Typically, the survey data and putting indicia are obtained together, and then the drafting software (or other suitable computerized or manual process) is used to create an embodiment of the invented device, including the representation of the green and the putting indicia and other elements depicted thereupon.

While the invention has been disclosed in its preferred form, the specific embodiments thereof as disclosed and illustrated herein are not to be considered in a limiting sense as numerous variations are possible. To reiterate, green 14 represents one example of a green for which the invented putting improvement device and method may be used, but the invention may be used with any green for which a representation and putting indicia are created, as described herein. Applicant regards the subject matter of the invention to include all novel and non-obvious combinations and subcombinations of the various elements, features, functions and/or properties disclosed herein. No single feature, function, element or property of the disclosed embodiments is essential to all embodiments. The following claims define certain combinations and subcombinations that are regarded as novel and non-obvious. Other combinations and subcombinations of features, functions, elements and/or properties may be claimed through amendment of the present claims or presentation of new claims in this or a related application. Such claims, whether they are broader, narrower or equal in scope to the original claims, are also regarded as included within the subject matter of applicant's invention.

I claim:

1. A putting improvement device, comprising:

a representation of a green; and a plurality of putting indicia on the representation, wherein each of the putting indicia identifies a determined path along which a golf ball will travel when putted on the green, and further wherein the determined paths are determined at least in part by a method other than manually propelling a golf ball along the green with a golf club.

2. The device of claim 1, wherein at least one of the putting indicia identifies a straight putt line.

3. The device of claim 1, wherein at least one of the putting indicia identifies a curved putt line.

4. The device of claim 1, wherein at least one of the putting indicia identifies a convergence band identifying a region within which putted golf balls will travel to a common terminal location, wherein the convergence band is bounded by a pair of putting indicia in the form of lines along which a putted golf ball will travel to the common terminal location, and wherein the convergence band further includes a surface extending between the pair of putting indicia in the form of lines.

5. The device of claim 1, wherein each path is determined by measuring the trajectory of a golf ball propelled along the green by a method other than manually propelling the golf ball along the green with a golf club.

6. The device of claim 1, wherein each of the plurality of putting indicia identifies a path along which a golf ball will travel when putted on the green, and wherein each path includes end points beyond which the golf ball will deviate from a linear extension of the path.

7. The device of claim 1, wherein the device further includes an indicator of the average speed of the green.

8. The device of claim 7, wherein the device further includes an indicator of the speed of the green when the plurality of putting indicia were measured.

9. The device of claim 1, wherein the representation includes elevation indicia depicting the topographical profile of the green.

10. The device of claim 1 adapted for use with a green having a predominant grain direction, wherein the device further includes an indicator of the predominant grain direction of the green.

11. The device of claim 1, wherein the putting indicia identify determined paths along which a golf ball will travel when putted on the green, regardless of the direction at which the golf ball is putted along the path.

12. The device of claim 1, wherein each of the putting indicia identifies a determined path along which a golf ball will travel when putted on the green, regardless of the position of the golf ball on the path when the ball is putted along the path.

13. A putting improvement device for a golf course having golf holes with greens, the device comprising:

a booklet containing representations of each of the greens, each representation corresponding to a respective one of the greens and including:

elevation indicia depicting the topographical profile of the corresponding green; and a plurality of putting benchmarks disposed on the representation and identifying predetermined paths along which a golf ball will travel when putted on the corresponding green, and further wherein the predetermined paths are determined at least in part by a method other than manually propelling a golf ball along the green with a golf club.

14. The device of claim 13, wherein the putting benchmarks are determined from measured paths of travel of one or more golf balls along the green.

15. The device of claim 13, wherein the putting benchmarks include end points beyond which a golf ball will deviate from a linear extension of the path identified by the corresponding benchmark.

16. The device of claim 13, wherein the booklet includes an indicator of the speed of the green at the time the benchmarks were measured.

17. The device of claim 13, wherein at least one of the plurality of putting benchmarks extends along a non-linear path.

18. The device of claim 13, wherein at least one of the plurality of putting benchmarks defines a region on the representation that corresponds to a region on the green within which golf balls will travel to a common terminal location when putted.

19. A method for improving putting on a green, comprising:

determining a plurality of paths on the green along which a golf ball will travel when putted, wherein the plurality of paths are determined at least in part by a method other than manually propelling a golf ball across the green with a golf club;

creating a topographical representation of the green; and projecting the plurality of fixed paths on the topographical representation to form a putting improvement device.

20. The method of claim 19, wherein the method further includes repeating the determining, creating and projecting steps for a plurality of greens.

21. A putting improvement device constructed according to the method of claim 19.

22. A putting improvement device constructed according to the method of claim 20.

23. The method of claim 19, wherein the determining step includes propelling a golf ball along the green and studying the path of the ball to determine if the path meets selected criteria, and further wherein the selected criteria include a straight path of travel.

24. The method of claim 23, wherein the determining step further includes repeating the propelling and studying steps along a different path from a starting position other than a terminal position from a prior determining step if the path fails to meet the selected criteria.

25. The method of claim 23, wherein the determining step further includes repeating the propelling and studying steps with a golf ball propelled along the path with a different force if the path fails to meet the selected criteria.

26. The method of claim 23, wherein the determining step further includes repeating the propelling and studying steps with a golf ball propelled along the path with greater force to determine terminal positions beyond which the path of the golf ball will fail to meet the selected criteria.

27. The method of claim 23, wherein the determining step includes repeating the propelling and studying steps in a different direction along the path to determine if the path meets the selected criteria in the different direction.

28. A putting improvement device constructed according to the method of claim 27.

29. A putting improvement device constructed according to the method of claim 23.

30. A putting improvement device, comprising:

a representation of a green; and a plurality of putting indicia on the representation, wherein each of the putting indicia identifies a determined path along which a golf ball will travel when putted on the green, wherein at least a portion of each path extends over a non-level portion of the green, and further wherein the putting indicia identify determined paths along which a golf ball will travel when putted on the green, regardless of the direction at which the golf ball is putted along the path.

31. A putting improvement device, comprising:

a representation of a green; and a plurality of putting indicia on the representation, wherein each of the putting indicia identifies a determined path along which a golf ball will travel when putted on the green, wherein at least a portion of each path extends over a non-level portion of the green, and further wherein each of the putting indicia identifies a determined path along which a golf ball will travel when putted on the green, regardless of the position of the golf ball on the path when the ball is putted along the path.

32. A method for improving putting on a green, comprising:

determining a plurality of paths on the green along which a golf ball will travel when putted, wherein determining each of the plurality of paths includes measuring a path of a golf ball on the green to create a measured path and verifying the measured path of the golf ball by repeating the determining step along the measured path to create a fixed path if the ball travels again along the measured path;

creating a topographical representation of the green; and projecting the plurality of fixed paths on the topographical representation to form a putting improvement device.

33. The method of claim 32, wherein the method further includes repeating the determining, creating and projecting steps for a plurality of greens.

34. A putting improvement device constructed according to the method of claim 32.

35. A putting improvement device constructed according to the method of claim 33.

36. A putting improvement device, comprising:

a representation of a green; and a plurality of putting indicia on the representation, wherein each of the putting indicia identifies a determined path along which a golf ball will travel when putted on the green, and further wherein each of the paths is determined by a method other than manually propelling a golf ball along the green with a golf club.

37. The putting improvement device of claim 36, wherein the plurality of indicia are determined at least in part from data points obtained using surveying equipment.

38. The putting improvement device of claim 36, wherein each of the paths is determined by urging a golf ball along the green using a selected reproducible amount of force.

* * * * *

UNITED STATES PATENT AND TRADEMARK OFFICE

CERTIFICATE OF CORRECTION

PATENT NO. : 6,296,579 B1
DATED : October 2, 2001
INVENTOR(S) : Lee D. Robinson

It is certified that error appears in the above-identified patent and that said Letters Patent is hereby corrected as shown below:

Column 1,
Line 10, delete "golfer's" and insert -- golfers' -- therefor.

Column 9,
Line 66, delete "continuing" and insert -- confirming -- therefor.

Column 10,
Line 29, after "as to determine" delete "this" and insert -- the -- therefor.
Line 56, after "survey and" delete "drifting" and insert -- drafting -- therefor.

Column 11,
Line 6, delete "game" and insert -- same -- therefor.

Signed and Sealed this

Twenty-first Day of May, 2002

*Attest:*

*Attesting Officer*

JAMES E. ROGAN
*Director of the United States Patent and Trademark Office*

US006296579C1

(12) EX PARTE REEXAMINATION CERTIFICATE (8105th)

United States Patent

Robinson

(10) Number: US 6,296,579 C1

(45) Certificate Issued: Mar. 22, 2011

(54) PUTTING IMPROVEMENT DEVICE AND METHOD

(75) Inventor: Lee D. Robinson, West Linn, OR (US)

(73) Assignee: The Stracka Design Company LLC, Houston, TX (US)

Reexamination Request:
No. 90/010,443, Mar. 5, 2009

Reexamination Certificate for:

| | |
|---|---|
| Patent No.: | **6,296,579** |
| Issued: | **Oct. 2, 2001** |
| Appl. No.: | **09/384,931** |
| Filed: | **Aug. 26, 1999** |

Certificate of Correction issued May 21, 2002.

(51) Int. Cl.
*A63B 67/02* (2006.01)

(52) U.S. Cl. ..... 437/407; 473/409

(58) Field of Classification Search ..... None
See application file for complete search history.

(56) References Cited

U.S. PATENT DOCUMENTS

| | | | | |
|---|---|---|---|---|
| 5,146,557 | A | | 9/1992 | Yamrom et al. |
| 5,319,548 | A | | 6/1994 | Germain |
| 5,403,001 | A | | 4/1995 | Skorpinski |
| 5,411,253 | A | | 5/1995 | Kimble |
| 6,027,417 | A | * | 2/2000 | Zoretic et al. ..... 473/407 |
| 6,171,199 | B1 | | 1/2001 | Cohodas et al. |
| 6,200,066 | B1 | | 3/2001 | Humphrey |

FOREIGN PATENT DOCUMENTS

| | | |
|---|---|---|
| GB | 2233197 | 2/1991 |
| JP | 6-305280 | 11/1994 |
| JP | 8-071194 | 3/1996 |

OTHER PUBLICATIONS

Merriam–Webster's Collegiate Dictionary, 10th ed., 1998, pp. 578, 932.*

New Re–Exam Request from Carlos Villamar.

* cited by examiner

*Primary Examiner*—Jeffrey L. Gellner

(57) ABSTRACT

A method and device for improving putting. The device includes a representation of a green on which a plurality of putting benchmarks are projected. The representation may also include elevation indicia and indicators of the speed and predominant grain direction of the green. The device is used to enable golfers to accurately read the green and determine the speed and direction along which a particular ball should be putted. Methods of using and creating the device are also disclosed.

At the time of issuance and publication of this certificate, the patent remains subject to pending reexamination control number 90/011,344 filed Nov. 19, 2010. The claim content of the patent may be subsequently revised if a reexamination certificate issues from the reexamination proceeding.

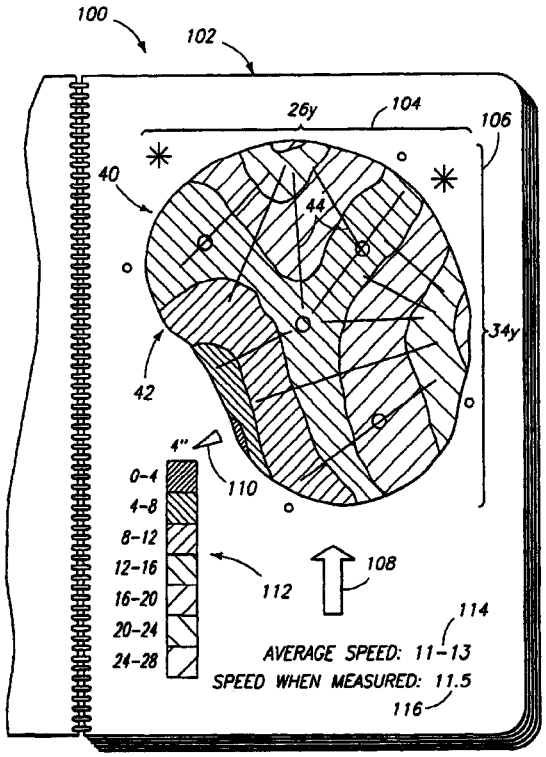

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-18, 21, 22 and 28-38 are cancelled.

Claims 19 and 20 are determined to be patentable as amended.

Claims 23, 24, 25, 26 and 27, dependent on an amended claim, are determined to be patentable.

New claims 39-60 are added and determined to be patentable.

19. A method for improving putting on a green, comprising:

determining a plurality of paths on the green along which a golf ball will travel when putted, wherein the plurality of paths are determined at least in part by a method other than manually propelling a golf ball across the green with a golf [club ;]*club, the plurality of paths being determined at least in part using survey data obtained from automated survey equipment or semi-automated survey equipment;* creating a topographical *profile* representation of the green [;and]*using software run by a computer configured to generate the topographical profile representation based on the survey data and user input, the user input relating to the determined paths and the topographical profile representation comprising elevation indicia identifying elevation at different positions of the green and other indicia for identifying the plurality of paths, the other indicia comprising at least one of putt line indicia and slope indicia, the slope indicia being different than the elevation indicia;*[projecting the plurality of fixed paths on the topographical representation to form a putting improvement device]

*preparing at least one page for a yardage booklet comprising at least one page illustrating the topographical profile representation of the green that has the elevation indicia and the other indicia disposed on the topographical profile representation for use during a game of golf for identifying at least one desirable putting path; and*

*projecting the plurality of paths on the illustrated topographical profile representation of the green on the at least one page for the yardage booklet, the projected paths comprising a plurality of fixed paths.*

20. The method of claim 19, wherein the method further includes repeating the determining, creating and [projecting] *preparing* steps for a plurality of greens.

*39. A method of providing a putting improvement device comprising:*

*determining a plurality of paths for movement of a putted golf ball on a putting green using at least in part automated survey equipment or semi-automated survey equipment to obtain topographical profile data of at least one putting green of a golf course, the paths determined at least in part by a method other than manually propelling a golf ball across the green with a golf club, the automated survey equipment or semi-automated survey equipment comprised of a device only requiring one operator to use the automated survey equipment or semi-automated survey equipment;*

*creating at least one topographical profile representation of the at least one putting green using software run by a computer configured to generate the at least one topographical profile representation based on the topographical profile data and user input, the at least one topographical profile representation comprising elevation indicia;*

*projecting other indicia on the at least one topographical profile representation, the other indicia illustrating locations of the determined paths; and*

*preparing at least one page for a yardage booklet comprising at least one page illustrating the at least one topographical profile representation of the at least one putting green and other indicia for use during a game of golf so that a golfer is able to identify any of a plurality of desirable putting paths on the at least one putting green.*

*40. The method of claim 39 wherein the other indicia for illustrating the paths is comprised of slope indicia and the elevation indicia is comprised of contour lines, the slope indicia being different than the contour lines.*

*41. The method of claim 39 wherein the other indicia is comprised of slope indicia and a plurality of benchmarks, the benchmarks comprising at least one of straight line putting paths disposed on the at least one topographical profile representation of the at least one putting green and curved putting paths disposed on the at least one topographical profile representation of the at least one putting green.*

*42. The method of claim 40 further comprising preparing a booklet comprising the at least one page illustrating the at least one topographical profile representation of the at least one putting green and wherein the other indicia illustrate the paths by identifying the paths.*

*43. The method of claim 39 further comprising preparing a booklet comprising the at least one page illustrating the at least one topographical profile representation of the at least one putting green.*

*44. The method of claim 39 wherein the other indicia is comprised of putt line indicia disposed on the at least one topographical profile representation of the at least one putting green and indicia for grain of the at least one putting green.*

*45. The method of claim 39 wherein the other indicia is comprised of slope indicia and the slope indicia is determined at least in part from the topographical profile data.*

*46. The method of claim 45 further comprising preparing a booklet comprised of the at least one page illustrating the at least one topographical profile representation of the at least one putting green.*

*47. The method of claim 39 wherein the other indicia is comprised of slope indicia and the slope indicia is determined at least in part from the topographical profile data, the elevation indicia being comprised of contour lines, the contour lines being illustrated on the at least one topographical profile representation of the at least one putting green differently than the slope indicia.*

*48. A method of providing a putting improvement device comprising:*

*determining paths along which a golf ball will travel when putted on a first putting green at least in part by a method other than manually propelling a golf ball across the first putting green with a golf club, the paths determined at least in part using automated survey equipment or semi-automated survey equipment to obtain first topographical profile data of a first putting green of a golf course;*

*creating a first topographical profile representation of the first putting green using software run by a computer configured to generate the first topographical profile representation based on the first topographical profile data, the first topographical profile representation comprising first elevation indicia;*

*creating first path indicia identifying paths along which a golf ball moves along the first putting green, the first path indicia illustrating locations for the paths on the first putting green;*

*projecting the first path indicia on the first topographical profile representation of the first putting green;*

*preparing at least one page for a yardage booklet, the at least on page comprising at least one page illustrating the first topographical profile representation of the first putting green and the first path indicia, the yardage booklet sized and configured for use during a game of golf so that a golfer is able to identify at least one desirable putting path on the first putting green.*

*49. The method of claim 48 wherein the elevation indicia is comprised of contour indicia, the contour indicia comprising contour lines, the first path indicia being comprised of indicia disposed on the first topographical profile representation.*

*50. The method of claim 49 further comprising:*

*using automated survey equipment or semi-automated survey equipment to obtain second topographical profile data of a second putting green of a golf course;*

*determining paths along which a golf ball will travel when putted on the second putting green at least in part by a method other than manually propelling a golf ball across the first putting green with a golf club, the paths determined at least in part using automated survey equipment or semi-automated survey equipment to obtain first topographical profile data of a first putting green of a golf course;*

*creating a second topographical profile representation of the second putting green using software run by a computer configured to generate the topographical profile representation based on the second topographical profile data, the second topographical profile representation comprising elevation indicia;*

*creating second path indicia identifying paths along which a golf ball moves along the second putting green, the second path indicia illustrating locations for the paths along which a golf ball moves on the second putting green, and*

*preparing at least one page for the yardage booklet comprising at least one page illustrating the second topographical profile representation of the second putting green and the second path indicia.*

*51. The method of claim 49 further comprising preparing a yardage book comprised of the at least one page illustrating the first topographical profile representation of the first putting green.*

*52. The method of claim 50 further comprising preparing a yardage book comprised of the at least one page illustrating the first topographical profile representation of the first putting green and the first path indicia and at least one page illustrating the second topographical profile representation of the second putting green and the second path indicia.*

*53. The method of claim 50 further comprising putting instructions on at least one page of the yardage booklet, the instructions describing information about indicia used in the yardage booklet and wherein the paths are determined by using a stimpometer to determine the paths.*

*54. The method of claim 50 wherein the first path indicia and the second path indicia are comprised of at least one of putting green speed indicia, slope indicia, grain indicia, and putting line indicia.*

*55. The method of claim 48 further comprising preparing a yardage book comprised of the at least one page illustrating the first topographical profile representation of the first putting green.*

*56. The method of claim 54 further comprising preparing a yardage book comprised of the at least one page illustrating the first topographical profile representation of the first putting green and the at least one page illustrating the second topographical profile representation of the second putting green and the second path indicia.*

*57. The method of claim 54 wherein the first path indicia and the second path indicia are comprised of the putting green speed indicia, the slope indicia and the putting line indicia.*

*58. The method of claim 57 further comprising preparing a yardage book comprised of the at least one page illustrating the first topographical profile representation of the first putting green and the at least one page illustrating the second topographical profile representation of the second putting green and the second path indicia.*

*59. A method for providing a device to improve putting comprising:*

*determining a plurality of paths on a putting green along which a golf ball will travel when putted at least in part by a method other than manually propelling a golf ball across the green with a golf club, wherein the plurality of paths are determined at least in part by using automated survey equipment or semi-automated survey equipment to obtain topographical profile data of a putting green of a golf course;*

*creating a topographical profile representation of the green using software run by a computer configured to generate the topographical profile representation based on the survey data, the topographical profile representation comprising elevation indicia identifying elevation at different positions of the green and other indicia for identifying the plurality of paths, the other indicia comprising at least one of putt line indicia and slope indicia, the slope indicia being different than the elevation indicia;*

*projecting the other indicia on the topographical profile representation to illustrate the paths such that the other indicia is disposed on the topographical profile representation; and*

*preparing at least one page for a booklet comprising at least one page illustrating the topographical profile representation of the green that has the elevation indicia and the other indicia disposed on the topographical profile representation for use during a game of golf for identifying at least one desirable putting path.*

*60. The method of claim 59 further comprising preparing a booklet comprising the at least one page illustrating the topographical profile representation of the green.*

* * * * *

US006296579C2

(12) EX PARTE REEXAMINATION CERTIFICATE (8974th)

United States Patent
Robinson

(10) Number: US 6,296,579 C2
(45) Certificate Issued: Apr. 17, 2012

(54) PUTTING IMPROVEMENT DEVICE AND METHOD

(75) Inventor: Lee D. Robinson, West Linn, OR (US)

(73) Assignee: The Stracka Design Company LLC, Houston, TX (US)

Reexamination Request:
No. 90/011,637, Apr. 8, 2011

Reexamination Certificate for:

| | |
|---|---|
| Patent No.: | **6,296,579** |
| Issued: | **Oct. 2, 2001** |
| Appl. No.: | **09/384,931** |
| Filed: | **Aug. 26, 1999** |

Reexamination Certificate C1 6,296,579 issued Mar. 22, 2011

Certificate of Correction issued May 21, 2002.

(51) Int. Cl.
*A63B 67/02* (2006.01)

(52) U.S. Cl. ..... 473/407; 473/409

(58) Field of Classification Search ..... None
See application file for complete search history.

(56) References Cited

To view the complete listing of prior art documents cited during the proceeding for Reexamination Control Number 90/011,637, please refer to the USPTO's public Patent Application Information Retrieval (PAIR) system under the Display References tab.

*Primary Examiner*—Jeffre R. Jastrzab

(57) ABSTRACT

A method and device for improving putting. The device includes a representation of a green on which a plurality of putting benchmarks are projected. The representation may also include elevation indicia and indicators of the speed and predominant grain direction of the green. The device is used to enable golfers to accurately read the green and determine the speed and direction along which a particular ball should be putted. Methods of using and creating the device are also disclosed.

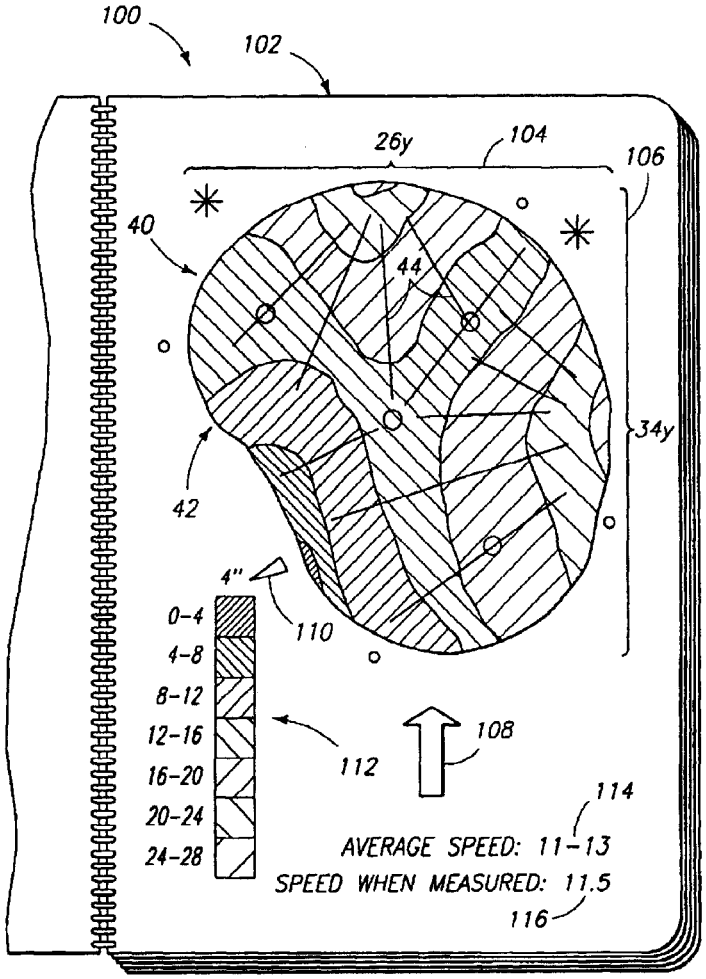

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-18, 21, 22 and 28-38 were previously cancelled.
Claims 19, 20 and 39-60 are cancelled.
Claims 23-27 were not reexamined.

* * * * *